US007095380B2

(12) United States Patent
Yoneda et al.

(10) Patent No.: US 7,095,380 B2
(45) Date of Patent: Aug. 22, 2006

(54) ANTENNA DEVICE

(75) Inventors: Naofumi Yoneda, Tokyo (JP); Moriyasu Miyazaki, Tokyo (JP); Yoshio Inasawa, Tokyo (JP); Yoshihiko Konishi, Tokyo (JP); Shigeru Makino, Tokyo (JP); Akio Iida, Tokyo (JP); Izuru Naitoh, Tokyo (JP); Toshiyuki Horie, Tokyo (JP); Hiroyuki Satoh, Tokyo (JP); Yutaka Shimawaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/534,106

(22) PCT Filed: Mar. 12, 2004

(86) PCT No.: PCT/JP2004/003303

§ 371 (c)(1),
(2), (4) Date: May 6, 2005

(87) PCT Pub. No.: WO2004/091051

PCT Pub. Date: Oct. 21, 2004

(65) Prior Publication Data

US 2006/0017641 A1 Jan. 26, 2006

(30) Foreign Application Priority Data

Apr. 4, 2003 (JP) ..... 2003-101788

(51) Int. Cl.
*H01Q 13/00* (2006.01)

(52) U.S. Cl. ..... 343/786; 343/776; 343/785; 343/781 CA

(58) Field of Classification Search ..... 343/781 CA, 343/786, 778, 771, 776; 333/135
See application file for complete search history.

(56) References Cited

U.S. PATENT DOCUMENTS

| | | | | |
|---|---|---|---|---|
| 4,498,062 | A * | 2/1985 | Massaglia et al. | 333/135 |
| 4,972,199 | A * | 11/1990 | Raghavan et al. | 343/756 |
| 5,075,649 | A * | 12/1991 | Pellegrineschi | 333/137 |
| 5,784,033 | A * | 7/1998 | Boldissar, Jr. | 343/786 |
| 6,323,819 | B1 * | 11/2001 | Ergene | 343/786 |
| 6,329,957 | B1 * | 12/2001 | Shea et al. | 343/756 |
| 2003/0137466 | A1 | 7/2003 | Yoneda et al. | |

FOREIGN PATENT DOCUMENTS

EP 0 805 511 A2 11/1997

(Continued)

OTHER PUBLICATIONS

Takashi Kitsuregawa, Artech House, 1990, pp. 232-235.
Anthony Monk et al., 21st, International Communications Satellite Systems Conference and Exhibit AIAA2003-2316, 2003, pp. 1-4.
K. Aoki et al., IEE Proc.-Microw. Antennas Propag., vol. 146, No. 1, Feb. 1999, pp. 60-64.

(Continued)

*Primary Examiner*—Hoang V. Nguyen
*Assistant Examiner*—Chuc Tran
(74) *Attorney, Agent, or Firm*—Birch, Stewart, Kolasch & Birch, LLP

(57) ABSTRACT

An antenna apparatus in which a combination of rectangular waveguides 9*a* and 10*a* and a combination of rectangular waveguides 9*b* and 10*b* are disposed bilateral symmetrically to each other, and a waveguide orthomode transducer 13 is disposed above a waveguide orthomode transducer 8 is provided. Therefore, the profile of the antenna apparatus can be reduced and the stability of installation of the antenna apparatus can be improved without impairing the electric characteristics of the antenna apparatus. Since the antenna apparatus has a bilateral symmetric structure, it excels in weight balance and offers stable performance from the viewpoint of mechanism.

10 Claims, 6 Drawing Sheets

FOREIGN PATENT DOCUMENTS

| | | | |
|---|---|---|---|
| JP | 11-17402 | A | 1/1999 |
| JP | 11-330801 | A | 11/1999 |
| JP | 2000-174516 | A | 6/2000 |
| JP | 2003-283202 | A | 10/2003 |
| WO | WO-02/071539 | A1 | 9/2002 |
| WO | WO-02/071540 | A1 | 9/2002 |

* cited by examiner

ANTENNA DEVICE

FIELD OF THE INVENTION

The present invention relates to an antenna apparatus used in, for example, a VHF band, a UHF band, a microwave band, a millimeter wave band, etc.

BACKGROUND OF THE INVENTION

A prior art antenna apparatus is equipped with a circularly polarized wave generator and a polarizer, which are mounted on a rotary joint or a rotary mechanism, so as to allow integral rotation of a reflector and a primary radiator (refer to the following non-patent reference 1).

[Non-Patent Reference 1]

Takashi Kitsuregawa, 'Advanced Technology in Satellite Communication Antennas: Electrical & Mechanical Design', ARTECH HOUSE INC., pp. 232 to 235, 1990.

A problem with the prior art antenna apparatus constructed as mentioned above is that while it can rotate both the reflector and the primary radiator in a direction of an elevation angle or in a direction of an azimuth angle, the part of the prior art antenna apparatus which is arranged above the rotary mechanism has a very large size and has a high position, and therefore the prior art antenna apparatus lacks in installation stability because the circularly polarized wave generator and the polarizer are placed on the rotary joint or the rotary mechanism.

The present invention is made in order to solve the above-mentioned problem, and it is therefore an object of the present invention to provide an antenna apparatus having a low profile and high installation stability without impairing its electric characteristics.

DISCLOSURE OF THE INVENTION

An antenna apparatus in accordance with the present invention includes a first rectangular waveguide for propagating a third linearly polarized wave signal outputted thereto from a second orthomode transducer, a second rectangular waveguide for propagating a fourth linearly polarized wave signal outputted thereto from the second orthomode transducer, and a third orthomode transducer for combining the third and fourth linearly polarized wave signals respectively propagated thereto by the first and the second rectangular waveguides into a circularly polarized wave signal, and for outputting the circularly polarized wave signal to a radiator, the first and second rectangular waveguides being disposed bilateral symmetrically to each other and the third orthomode transducer being disposed below the second orthomode transducer.

Therefore, the present embodiment offers an advantage of being able to reduce the profile of the antenna apparatus and to improve the installation stability without impairing the electric characteristics of the antenna apparatus.

PREFERRED EMBODIMENTS OF THE INVENTION

Hereafter, in order to explain this invention in greater detail, the preferred embodiments of the present invention will be described with reference to the accompanying drawings.

Embodiment 1

Figure 1:
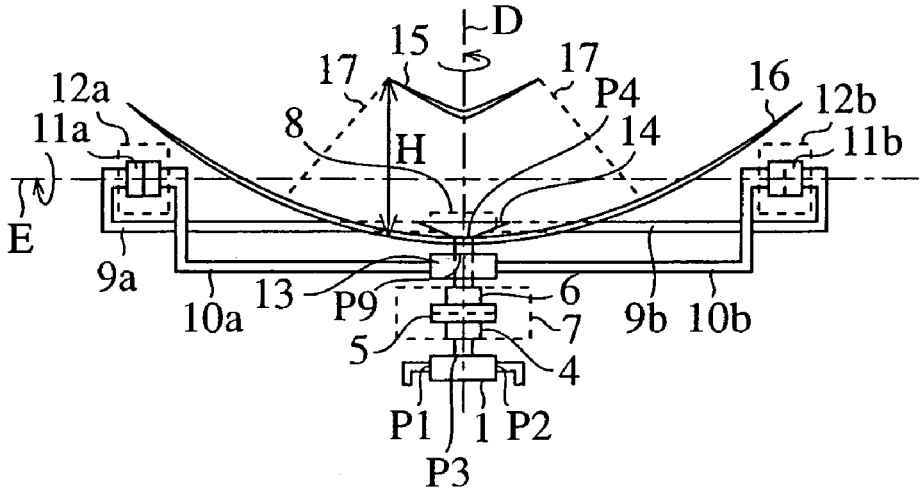
FIG. 1 is a side view showing an antenna apparatus according to embodiment 1 of the present invention.
Figure 2:
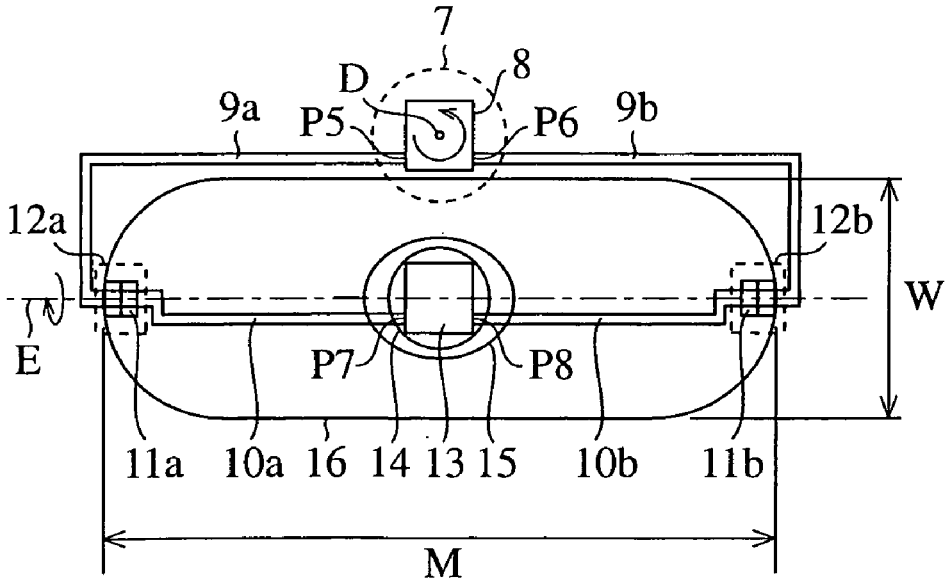
FIG. 2 is a top plan view showing the antenna apparatus of FIG. 1.

FIG. 1 is a side view showing an antenna apparatus according to embodiment 1 of the present invention, and FIG. 2 is a top plan view showing the antenna apparatus of FIG. 1.

In the figure, a waveguide orthomode transducer 1 constitutes a first orthomode transducer that when receives both a linearly polarized wave signal L1 (i.e., a first linearly polarized wave signal) via an input/output terminal P1 and a linearly polarized wave signal (i.e., a second linearly polarized wave signal) L2 having the same amplitude as the linearly polarized wave signal L1 via an input/output terminal P2 and having a phase difference of 90 degrees with respect to the linearly polarized wave signal L1, combines the linearly polarized wave signal L1 and the linearly polarized wave signal L2 into a composite signal and then outputs a circularly polarized wave signal C1 that is the composite signal via an input/output terminal P3.

A rectangular-to-circular waveguide transformer 4 is connected to the waveguide orthomode transducer 1, and propagates the circularly polarized wave signal C1 outputted from the input/output terminal P3 of the waveguide orthomode transducer 1 to another rectangular-to-circular waveguide transformer 6. The other rectangular-to-circular waveguide transformer 6 propagates the circularly polarized wave signal C1 propagated thereto by the rectangular-to-circular waveguide transformer 4 to a waveguide orthomode transducer 8.

A rectangular waveguide rotary joint 5 is inserted between the rectangular-to-circular waveguide transformer 4 and the other rectangular-to-circular waveguide transformer 6, and constitutes an azimuth rotary member that supports rotation of members (for example, a primary radiator 14, a main reflector 16, and a subreflector 15), which are disposed above the rectangular waveguide rotary joint 5, in a direction of an azimuth angle under the control of an azimuth rotary mechanism 7. It is assumed that the rectangular waveguide rotary joint 5 is constructed so that a circular-waveguide TE11 mode is defined as a propagation mode. The azimuth rotary mechanism 7 is a mechanical unit for rotating the rectangular waveguide rotary joint 5 about an azimuth axis D.

The waveguide orthomode transducer 8 is disposed above the waveguide orthomode transducer 1, and constitutes a second orthomode transducer that, when receiving the circularly polarized wave signal C1 outputted thereto from the rectangular-to-circular waveguide transformer 6 via the input/output terminal P4, separates the circularly polarized wave signal C1 into a linearly polarized wave signal (i.e., a third linearly polarized wave signal) L3 and a linearly polarized wave signal (i.e., a fourth linearly polarized wave signal) L4 having the same amplitude as the linearly polarized wave signal L3 and having a phase difference of 90 degrees with respect to the linearly polarized wave signal L3, and then outputs the third and fourth linearly polarized wave signals L3 and L4 via input/output terminals P5 and P6, respectively.

A rectangular waveguide 9*a* propagates the linearly polarized wave signal L3 outputted thereto via the input/output terminal P5 of the waveguide orthomode transducer 8 to another rectangular waveguide 10*a*, and the other rectangular waveguide 10*a* the propagates the linearly polarized wave signal L3 to a waveguide orthomode transducer 13. The rectangular waveguides 9*a* and 10*a* constitute a first rectangular waveguide.

A rectangular waveguide 9*b* propagates the linearly polarized wave signal L4 outputted thereto via the input/output terminal P6 of the waveguide orthomode transducer 8 to another rectangular waveguide 10*b*, and the other rectangular waveguide 10*b* then propagates the linearly polarized wave signal L4 to a waveguide orthomode transducer 13. The rectangular waveguides 9*b* and 10*b* constitute a second rectangular waveguide.

The rectangular waveguides 9*a* and 9*b* are formed so that they are bilateral symmetric to each other, and the rectangular waveguides 10*a* and 10*b* are formed so that they are bilateral symmetric to each other.

A rectangular waveguide rotary joint 11*a* is inserted between the rectangular waveguide 9*a* and the rectangular waveguide 10*a*, and constitutes an elevation angle rotary member that supports rotation of the waveguide orthomode transducer 13, the primary radiator 14, the subreflector 15, and the main reflector 16 in a direction of an elevation angle under the control of an elevation angle rotary mechanism 12*a*. The elevation angle rotary mechanism 12*a* is a mechanical unit for rotating the rectangular waveguide rotary joint 11*a* around an elevation angle axis E.

Another rectangular waveguide rotary joint 11*b* is also inserted between the rectangular waveguide 9*b* and the rectangular waveguide 10*b*, and constitutes an elevation angle rotary member that supports rotation of the waveguide orthomode transducer 13, the primary radiator 14, the subreflector 15, and the main reflector 16 in the direction of the elevation angle under the control of an elevation angle rotary mechanism 12*b*. The elevation angle rotary mechanism 12*b* is a mechanical unit for rotating the rectangular waveguide rotary joint 11*b* around the elevation angle axis E.

The waveguide orthomode transducer 13 is disposed below the waveguide orthomode transducer 8, and constitutes a third orthomode transducer that when receiving both the linearly polarized wave signal L3 propagated by the rectangular waveguide 10*a* via an input/output terminal P7 and the linearly polarized wave signal L4 propagated by the rectangular waveguide 10*b* via an input/output terminal P8, combines the linearly polarized wave signals L3 and L4 into a composite signal, and then outputs a circularly polarized wave signal C2 which is the composite signal via an input/output terminal P9. The primary radiator 14 is disposed above the waveguide orthomode transducer 13, and emits the circularly polarized wave signal C2 outputted thereto via the input/output terminal P9 of the waveguide orthomode transducer 13 to the subreflector 15.

The subreflector 15 is disposed so that its reflecting surface is oriented in a downward direction and reflects the circularly polarized wave signal C2 emitted from the primary radiator 14 toward the main reflector 16. The main reflector 16 is disposed so that its reflecting surface is oriented in an upward direction and emits the circularly polarized wave signal C2 reflected by the subreflector 15 in the air. A supporting structure 17 supports the subreflector 15 and the main reflector 16 so that they are apart from each other and are aligned along the azimuth axis.

Next, the operation of the antenna apparatus in accordance with this embodiment of the present invention will be explained.

A case where the antenna apparatus emits a circularly polarized wave signal C2 toward a target will be explained first.

When receiving both a linearly polarized wave signal L1 via the input/output terminal P1 and a linearly polarized wave signal L2 having the same amplitude as the linearly polarized wave signal L1 via the input/output terminal P2 and having a phase difference of 90 with respect to the linearly polarized wave signal L1, the waveguide orthomode transducer 1 combines the linearly polarized wave signals L1 and L2 into a composite signal and then outputs a circularly polarized wave signal C1 that is the composite signal via the input/output terminal P3.

When receiving the circularly polarized wave signal C1 from the input/output terminal P3 of the waveguide orthomode transducer 1, the rectangular-to-circular waveguide transformer 4 propagates the circularly polarized wave signal C1 to the rectangular-to-circular waveguide transformer 6, and the rectangular-to-circular waveguide transformer 6 then propagates the circularly polarized wave signal C1 propagated by the rectangular-to-circular waveguide transformer 4 to the waveguide orthomode transducer 8.

When receiving the circularly polarized wave signal C1 propagated by the rectangular-to-circular waveguide transformer 6 from the input/output terminal P4, the waveguide orthomode transducer 8 separates the circularly polarized wave signal C1 into linearly polarized wave signals L3 and L4, and then outputs the linearly polarized wave signal L3 via the input/output terminal P5 and outputs the linearly polarized wave signal L4 having the same amplitude as the linearly polarized wave signal L3 and having a phase difference of 90 degrees with respect to the linearly polarized wave signal L3 via the input/output terminal P6.

When receiving the linearly polarized wave signal L3 from the input/output terminal P5 of the waveguide orthomode transducer 8, the rectangular waveguide 9*a* propagates the linearly polarized wave signal L3 to the rectangular waveguide 10*a*, and the rectangular waveguide 10*a* then propagates the linearly polarized wave signal L3 to the waveguide orthomode transducer 13.

On the other hand, when receiving the linearly polarized wave signal L4 from the input/output terminal P6 of the waveguide orthomode transducer 8, the rectangular waveguide 9*b* propagates the linearly polarized wave signal L4 to the rectangular waveguide 10*b*, and the rectangular waveguide 10*b* then propagates the linearly polarized wave signal L4 to the waveguide orthomode transducer 13.

When receiving both the linearly polarized wave signal L3 propagated by the rectangular waveguide 10*a* via the input/output terminal P7 and the linearly polarized wave signal L4 propagated by the rectangular waveguide 10*b* via the input/output terminal P8, the waveguide orthomode transducer 13 combines the linearly polarized wave signals L3 and L4 into a composite signal, and then outputs a circularly polarized wave signal C2 which is the composite signal via the input/output terminal P9.

When receiving the circularly polarized wave signal C2 from the input/output terminal P9 of the waveguide orthomode transducer 13, the primary radiator 14 emits the circularly polarized wave signal C2 to the subreflector 15.

As a result, the circularly polarized wave signal C2 is reflected toward the main reflector 16 by the subreflector 15, and is further reflected toward the air by the main reflector 16.

Although the rectangular waveguide rotary joints 11*a* and 11*b* rotate the waveguide orthomode transducer 13, the primary radiator 14, the subreflector 15, and the main reflector 16 around the elevation angle axis E under the control of the elevation angle rotary mechanisms 12*a* and 12*b*, and the rectangular waveguide rotary joint 5 rotates the waveguide orthomode transducer 8, the rectangular waveguides 9*a*, 9*b*, 10*a*, and 10*b*, the waveguide orthomode transducer 13, the primary radiator 14, the subreflector 15, and the main reflector 16 around the azimuth axis D under the control of the azimuth rotary mechanism 7, the amplitude and phase relationship between the linearly polarized wave signals L3 and L4 inherits the amplitude and phase relationship between the linearly polarized wave signals L1 and L2 because the rectangular waveguides 9*a* and 9*b* are formed so that they are bilateral symmetric to each other and the rectangular waveguides 10*a* and 10*b* are formed so that they are bilateral symmetric to each other. In other words, the linearly polarized wave signal L3 and the linearly polarized wave signal L4 are equal in amplitude, and are 90 degrees out of phase with each other.

Therefore, even if the waveguide orthomode transducer, the primary radiator, the subreflector, and the main reflector are driven over a large angle range with respect to the direction of the elevation angle, the good circularly polarized wave state of the circularly polarized wave signal C2 outputted from the input/output terminal P9 of the waveguide orthomode transducer 13 can be maintained. The antenna apparatus can thus emit a good-quality circularly polarized wave signal in a wide band.

Since the rectangular waveguide rotary joint 5 is constructed so that the circular-waveguide TE11 mode is defined as the propagation mode, it can drive the waveguide orthomode transducer, the rectangular waveguides, the other waveguide orthomode transducer, the primary radiator, the subreflector, and the main reflector over a large angle range with respect to the direction of the azimuth angle without impairing the electrical characteristics of the antenna apparatus of this embodiment. Therefore, the antenna apparatus can transmit the circularly polarized wave signal while carrying out scanning of the antenna beam over a wide angle. It can be further expected that the antenna apparatus exhibits good passage and reflection characteristics over a wide band.

Next, a case where the antenna apparatus receives a circularly polarized wave signal C2 reflected from a target will be explained.

When receiving the circularly polarized wave signal C2, the main reflector 16 reflects the circularly polarized wave signal C2 toward the subreflector 15. The circularly polarized wave signal C2 is then reflected by the subreflector 15 and is made to be incident upon the primary radiator 14.

When receiving the circularly polarized wave signal C2, the primary radiator 14 outputs the circularly polarized wave signal C2 to the waveguide orthomode transducer 13.

When receiving the circularly polarized wave signal C2 outputted from the primary radiator 14 via the input/output terminal P9, the waveguide orthomode transducer 13 separates the circularly polarized wave signal C2 into linearly polarized wave signals L3 and L4, and then outputs the linearly polarized wave signal L3 via the input/output terminal P7 and also outputs the linearly polarized wave signal L4 having the same amplitude as the linearly polarized wave signal L3 and having a phase difference of 90 degrees with respect to the linearly polarized wave signal L3 via the input/output terminal P8.

When receiving the linearly polarized wave signal L3 from the input/output terminal P7 of the waveguide orthomode transducer 13, the rectangular waveguide 10*a* propagates the linearly polarized wave signal L3 to the rectangular waveguide 9*a*, and the rectangular waveguide 9*a* then propagates the linearly polarized wave signal L3 to the waveguide orthomode transducer 8.

On the other hand, when receiving the linearly polarized wave signal L4 from the input/output terminal P8 of the waveguide orthomode transducer 13, the rectangular waveguide 10*b* propagates the linearly polarized wave signal L4 to the rectangular waveguide 9*b*, and the rectangular waveguide 9*b* then propagates the linearly polarized wave signal L4 to the waveguide orthomode transducer 8.

When receiving the linearly polarized wave signal L3 propagated by the rectangular waveguide 9*a* via the input/output terminal P5 and also receiving the linearly polarized wave signal L4 propagated by the rectangular waveguide 9*b* via the input/output terminal P6, the waveguide orthomode transducer 8 combines the linearly polarized wave signals L3 and L4 into a composite signal, and then outputs a circularly polarized wave signal C1 which is the composite signal via the input/output terminal P4.

When receiving the circularly polarized wave signal C1 from the input/output terminal P4 of the waveguide orthomode transducer 8, the rectangular-to-circular waveguide transformer 6 propagates the circularly polarized wave signal C1 to the other rectangular-to-circular waveguide transformer 4, and the other rectangular-to-circular waveguide transformer 4 then propagates the circularly polarized wave signal C1 propagated by the rectangular-to-circular waveguide transformer 6 to the waveguide orthomode transducer 1.

When receiving the circularly polarized wave signal C1 propagated by the rectangular-to-circular waveguide transformer 4 from the input/output terminal P3, the waveguide orthomode transducer 1 separates the circularly polarized wave signal C1 into linearly polarized wave signals L1 and L2, and then outputs the linearly polarized wave signal L1 via the input/output terminal P1 and also outputs the linearly polarized wave signal L2 having the same amplitude as the linearly polarized wave signal L1 and having a phase difference of 90 degrees with respect to the linearly polarized wave signal L1 via the input/output terminal P2.

The antenna apparatus carries out reception of a circularly polarized wave signal in this way. As in the case of transmission of a circularly polarized wave signal, the antenna apparatus can drive the waveguide orthomode transducer, the rectangular waveguides, the other waveguide orthomode transducer, the primary radiator, the subreflector, and the main reflector over a wide angle range in both the direction of the elevation angle and the direction of the azimuth angle so as to receive a circularly polarized wave signal in good condition.

As shown in FIG. 2, the main reflector 16 is an antenna having a rectangular aperture having a length "M" which is a size in the direction of the elevation angle axis of rotation E and a length "W" (M>W) which is a size in a direction (referred to as a width direction from here on) perpendicular to the elevation angle axis of rotation E. The subreflector 15 is also an antenna having a rectangular aperture whose size in the direction of the elevation angle axis of rotation E is larger than its size in the width direction.

The elevation angle axis of rotation E is made to pass through an almost central position of the distance (i.e., the height) H between the main reflector and the subreflector in the direction (i.e., the height direction) of the azimuth axis of rotation D of the main reflector 16 (refer to FIG. 1), and to pass through an almost central position of the main reflector 16 with respect to the width direction.

Therefore, when the main reflector 16 and the subreflector 15 are rotated around the elevation angle axis of rotation E, a movable area in which the main reflector 16 and the subreflector 15 can be moved exists within a circle which is delineated by the outermost edge of the main reflector 16, the circle having a center oh the elevation angle axis of rotation E.

The movable area defined by this circle is very small as compared with that provided by prior art antenna apparatus, and the profile of the antenna apparatus of this embodiment does not increase even if the main reflector 16 and the subreflector 15 are made to rotate around the elevation angle axis of rotation E.

The main reflector 16 and the subreflector 15 are shaped, and receive and reflect almost all of electromagnetic waves supplied thereto. Since a concrete procedure for shaping the main reflector 16 and the subreflector 15 is well known in this technical field, the detailed explanation of the concrete procedure for shaping the main reflector 16 and the subreflector 15 will be omitted hereafter. The procedure for shaping the main reflector and the subreflector is a technique for controlling the aperture shape and aperture distribution of an antenna, which is described in detail in, for example, IEE Proc. Microw. Antennas Propag. Vol. 146, No. 1, pp. 60 to 64, 1999.

In this embodiment, the main reflector and the subreflector are shaped so that the aperture of the antenna has a nearly rectangular shape and the aperture distribution becomes uniform.

As can be seen from the above description, in accordance with this embodiment 1, the rectangular waveguides 9*a* and 10*a* are formed so that they are bilateral symmetric to each other, the rectangular waveguides 9*b* and 10*b* are formed so that they are bilateral symmetric to each other, and the waveguide orthomode transducer 13 is disposed below the waveguide orthomode transducer 8. Therefore, the present embodiment offers an advantage of being able to reduce the profile of the antenna apparatus and to improve the installation stability without impairing the electric characteristics of the antenna apparatus.

In other words, the present embodiment offers an advantage of being able to achieve a downsizing and a low profile of the antenna apparatus by reducing the profile of the antenna apparatus. In addition, since the antenna apparatus has a bilateral symmetric structure, it excels in weight balance and offers stable performance from the viewpoint of mechanism.

Embodiment 2

Figure 3:
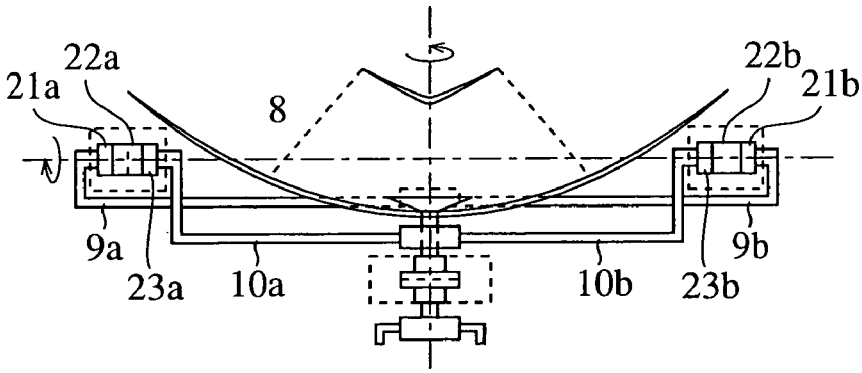
FIG. 3 is a side view showing an antenna apparatus according to embodiment 2 of the present invention.

In above-mentioned embodiment 1, the rotation of the antenna apparatus around the elevation angle axis of rotation E is implemented by inserting each of the rectangular waveguide rotary joints 11*a* and 11*b* between rectangular waveguides, as previously mentioned. As shown in FIG. 3, the rotation of the antenna apparatus around the elevation angle axis of rotation E can be alternatively implemented by inserting each of coaxial-cable rotary joints 22*a* and 22*b* between rectangular waveguides.

In other words, a coaxial-cable-to-rectangular-waveguide converter 21*a* is connected to a rectangular waveguide 9*a* and another coaxial-cable-to-rectangular-waveguide converter 23*a* is connected to a rectangular waveguide 10*a*, and the coaxial-cable rotary joint 22*a* is inserted between the coaxial-cable-to-rectangular-waveguide converter 21*a* and the other coaxial-cable-to-rectangular-waveguide converter 23*a*.

In addition, a coaxial-cable-to-rectangular-waveguide converter 21*b* is connected to a rectangular waveguide 9*b* and another coaxial-cable-to-rectangular-waveguide converter 23*b* is connected to a rectangular waveguide 10*b*, and the coaxial-cable rotary joint 22*b* is inserted between the coaxial-cable-to-rectangular-waveguide converter 21*b* and the other coaxial-cable-to-rectangular-waveguide converter 23*b*.

Thus, the antenna apparatus according to this embodiment is partially constructed of coaxial cables. Therefore, the present embodiment offers an advantage of being able to transmit and receive a good-quality circularly polarized wave signal in a further wide band without impairing a downsizing and a low profile of the antenna apparatus, and without preventing wide angle scanning.

Embodiment 3

Figure 4:
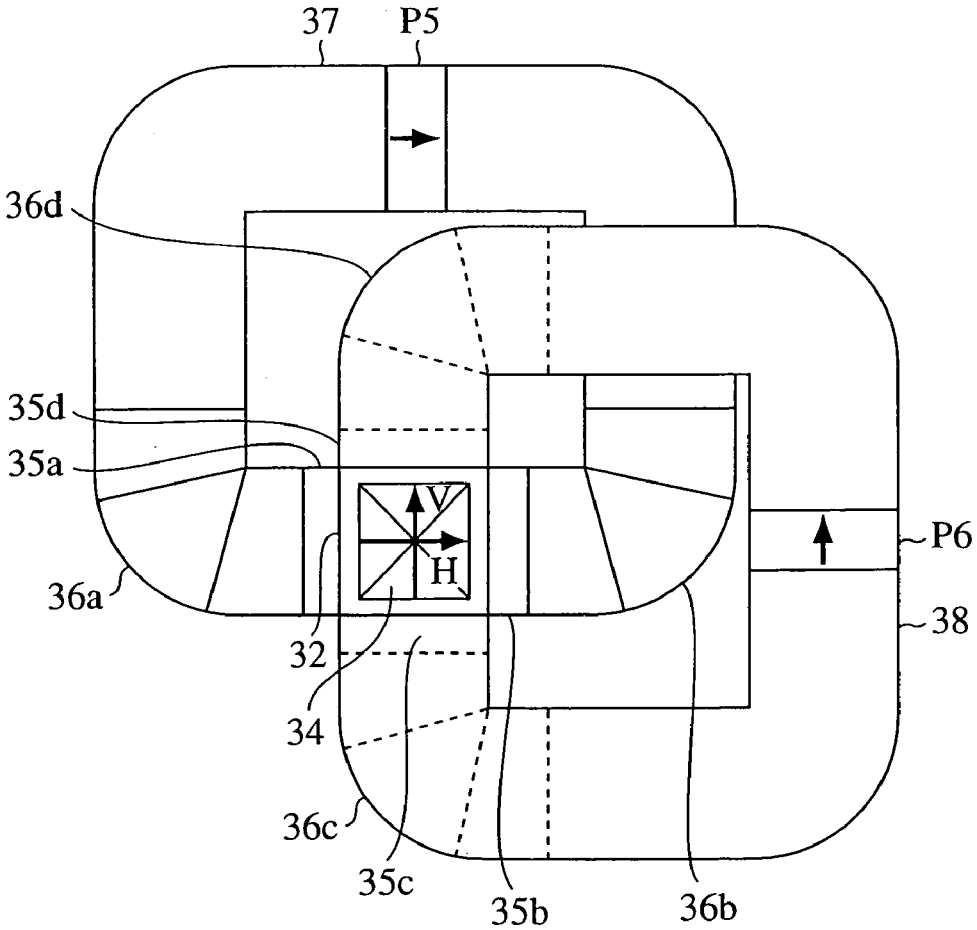
FIG. 4 is a top plan view showing waveguide orthomode transducers 1 and 8 of an antenna apparatus according to embodiment 3 of the present invention.
Figure 5:
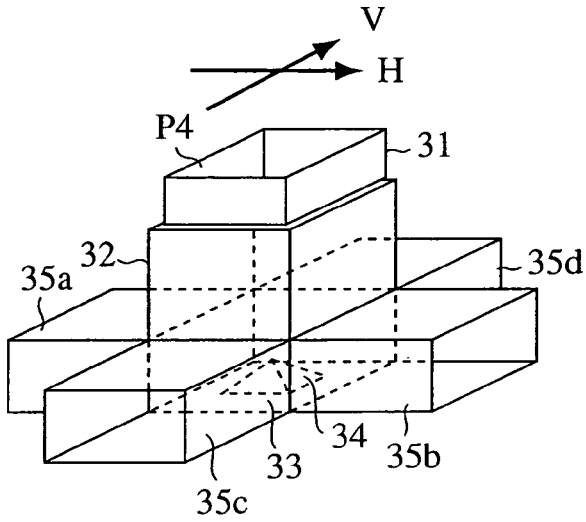
FIG. 5 is a perspective diagram showing a waveguide orthomode transducer of FIG. 4.

In either of above-mentioned embodiments 1 and 2, the internal structure of each of the waveguide orthomode transducers 1, 8, and 13 is not illustrated. Each of the waveguide orthomode transducers 1, 8, and 13 can have an internal structure as shown in FIGS. 4 and 5. The waveguide orthomode transducers 1, 8, and 13 can have the same structure. For the sake of simplicity, FIGS. 4 and 5 show the structure of the waveguide orthomode transducer 8.

In FIGS. 4 and 5, when receiving a circularly polarized wave signal C1 outputted thereto by a rectangular-to-circular waveguide transformer 6 via an input/output terminal P4, a square main waveguide 31 transmits the circularly polarized wave signal (including a vertically polarized electric wave and a horizontally polarized electric wave) C1. Another square main waveguide 32 has an aperture diameter larger than that of the square main waveguide 31 and a level difference at a connecting portion where it is connected to the square main waveguide 31, the level difference being sufficiently smaller than the free space wavelength of an available frequency band. The other square main waveguide 32 transmits the circularly polarized wave signal (including a vertically polarized electric wave and a horizontally polarized electric wave) C1 transmitted thereto by the square main waveguide 31.

A short-circuit plate 33 blocks one terminal of the square main waveguide 32, and a quadrangular-pyramid-shaped metallic block 34 is disposed on the short-circuit plate 33 and separates the circularly polarized wave signal into the vertically polarized electric wave and the horizontally polarized electric wave. An electric wave branching means comprises the square main waveguides 31 and 32, the short-circuit plate 33, and the quadrangular-pyramid-shaped metallic block 34.

Rectangular waveguide branching units 35*a* to 35*d* are connected to the square main waveguide 32 so that they are perpendicular to the four waveguide axes of the square main waveguide 32, respectively. Rectangular waveguide multi-stage transformers 36*a* to 36*d* are connected to the rectangular waveguide branching units 35*a* to 35*d*, respectively, and have waveguide axes that are curved in an H plane and have aperture diameters which decrease with distance from the rectangular waveguide branching units 35*a* to 35*d*, respectively. A rectangular waveguide E-plane T-branching circuit 37 combines a horizontally polarized electric wave transmitted by the rectangular waveguide multi-stage transformer 36*a* and a horizontally polarized electric wave transmitted by the rectangular waveguide multi-stage transformer 36*b* into a composite signal, and then outputs a linearly polarized wave signal L3 which is the composite signal via the input/output terminal P5. Another rectangular waveguide E-plane T-branching circuit 38 combines a vertically polarized electric wave transmitted by the rectangular waveguide multi-stage transformer 36*c* and a vertically polarized electric wave transmitted by the rectangular waveguide multi-stage transformer 36*d* into a composite signal, and then outputs a linearly polarized wave signal L4 which is the composite signal via the input/output terminal P6.

A first electric wave propagating means comprises the rectangular waveguide branching units 35*a* and 35*b*, the rectangular waveguide multi-stage transformers 36*a* and 36*b*, and the rectangular waveguide E-plane T-branching circuit 37, and a second electric wave propagating means comprises the rectangular waveguide branching units 35*c* and 35*d*, the rectangular waveguide multi-stage transformers 36*c* and 36*d*, and the rectangular waveguide E-plane T-branching circuit 38.

Next, the operation of the waveguide orthomode transducer in accordance with this embodiment of the present invention will be explained.

When the antenna apparatus receives a horizontally polarized electric wave H of basic mode (i.e., TE01 mode) via the input/output terminal P4, the square main waveguides 31 and 32 transmit the horizontally polarized electric wave H to the quadrangular-pyramid-shaped metallic block.

When the horizontally polarized electric wave H then reaches the quadrangular-pyramid-shaped metallic block 34, the quadrangular-pyramid-shaped metallic block causes it to branch toward both the direction of the rectangular waveguide branching unit 35*a* and the direction of the rectangular waveguide branching unit 35*b* (in the figures, the directions of H: first horizontal symmetrical directions).

In other words, since each of the rectangular waveguide branching units 35*c* and 35*d* has upper and lower walls having a gap which is equal to or smaller than one half of the free space wavelength of the available frequency band, the horizontally polarized electric wave H is not made to branch toward the directions of the rectangular waveguide branching units 35*c* and 35*d* (in the figures, in the directions of V: second horizontal symmetrical directions) due to the interception effect of the rectangular waveguide branching units 35*c* and 35*d*, but is made to branch toward the directions of the rectangular waveguide branching units 35*a* and 35*b* (in the figures, in the directions of H).

Since the orientation of the electric field is changed along the quadrangular-pyramid-shaped metallic block 34 and the short-circuit plate 33, the electric field has a distribution equivalent to an electric field distribution provided by two rectangular waveguide E-plane miter bends having excellent reflective characteristics which are placed so that they are symmetric to each other. Therefore, the horizontally polarized electric wave H is efficiently outputted in the directions of the rectangular waveguide branching units 35*a* and 35*b* while leakage of the horizontally polarized electric wave H in the directions of the rectangular waveguide branching units 35*c* and 35*d* is suppressed.

The level difference between the square main waveguides 31 and 32 at the connecting portion where the square main waveguide 31 is connected to the square main waveguide 32 is so designed as to be sufficiently small as compared with the free space wavelength of the available frequency band, and the connecting portion between the square main waveguides 31 and 32 has reflection characteristics in which there is a large reflection loss in a frequency band near the cut-off frequency of the basic mode of the horizontally polarized electric wave H and there is a very small reflection loss in a frequency band to some extent higher than the cut-off frequency. The reflection characteristics are similar to the reflection characteristics of the above-mentioned branching portion at which the horizontally polarized electric wave H is made to branch toward the directions of the rectangular waveguide branching units 35*a* and 35*b*, and the above-mentioned connecting portion is positioned so that a reflected wave from the branching portion and a reflected wave from the above-mentioned connecting portion cancel each other out in a band close to the cut-off frequency. Therefore, any degradation in the reflection characteristics in the frequency band near the cut-off frequency can be suppressed without impairing the good reflection characteristics in the frequency band to some extent higher than the cut-off frequency of the basic mode of the horizontally polarized electric wave H.

Each of the rectangular waveguide multi-stage transformers 36*a* and 36*b* has a waveguide axis which is curved, and has an upper wall in which two or more level differences are formed and the level differences are arranged at intervals of about one quarter of the wavelength of an electric wave propagating therethrough with respect to a centerline of the waveguide. After all, the two components in the directions of the rectangular waveguide branching units 35*a* and 35*b* toward which the electric wave H is made to branch are combined into a composite wave signal by the rectangular waveguide E-plane T-branching circuit 37 and the composite wave signal is efficiently outputted via the input/output terminal P5 without the reflection characteristics of the waveguide orthomode transducer being impaired.

On the other hand, when the waveguide orthomode transducer receives a vertically polarized electric wave V of basic mode (i.e., TE10 mode) via the input/output terminal P4, the square main waveguides 31 and 32 transmit the vertically polarized electric wave V to the quadrangular-pyramid-shaped metallic block.

When the vertically polarized electric wave V then reaches the quadrangular-pyramid-shaped metallic block 34, the quadrangular-pyramid-shaped metallic block makes it branch toward both a direction of the rectangular waveguide branching unit 35*c* and a direction of the rectangular waveguide branching unit 35*d* (in the figures, the directions of V).

In other words, since each of the rectangular waveguide branching units 35*a* and 35*b* has upper and lower walls having a gap which is equal to or smaller than one half of the free space wavelength of the available frequency band, the vertically polarized electric wave V is not made to branch toward the directions of the rectangular waveguide branching units 35*a* and 35*b* (in the figures, in the directions of H) due to the interception effect of the rectangular waveguide branching units 35*a* and 35*b*, but is made to branch toward the directions of the rectangular waveguide branching units 35*c* and 35*d* (in the figures, in the directions of V).

Since the orientation of the electric field is changed along the quadrangular-pyramid-shaped metallic block 34 and the short-circuit plate 33, the electric field has a distribution equivalent to an electric field distribution provided by two rectangular waveguide E-plane miter bends having excellent reflection characteristics which are placed so that they are symmetric to each other. Therefore, the vertically polarized electric wave V is efficiently outputted in the directions of the rectangular waveguide branching units 35*c* and 35*d* while leakage of the vertically polarized electric wave V in the directions of the rectangular waveguide branching units 35*a* and 35*b* is suppressed.

The level difference between the square main waveguides 31 and 32 at the connecting portion where the square main waveguide 31 is connected to the square main waveguide 32 is so designed as to be sufficiently small as compared with the free space wavelength of the available frequency band, and the connecting portion between the square main waveguides 31 and 32 has reflection characteristics in which there is a large reflection loss in a frequency band near the cut-off frequency of the basic mode of the vertically polarized electric wave V and there is a very small reflection loss in a frequency band to some extent higher than the cut-off frequency. The reflection characteristics are similar to the reflection characteristics of the above-mentioned branching portion at which the vertically polarized electric wave V is made to branch toward the directions of the rectangular waveguide branching units 35*c* and 35*d*, and the above-mentioned connecting portion is positioned so that a reflected wave from the branching portion and a reflected wave from the above-mentioned connecting portion cancel each other out in a band close to the cut-off frequency. Therefore, any degradation in the reflection characteristics in the frequency band near the cut-off frequency can be suppressed without impairing the good reflection characteristics in the frequency band to some extent higher than the cut-off frequency of the basic mode of the vertically polarized electric wave V.

Each of the rectangular waveguide multi-stage transformers 36*c* and 36*d* has a waveguide axis which is curved, and has a lower wall in which two or more level differences are formed and the level differences are arranged at intervals of about one quarter of the wavelength of an electric wave propagating therethrough with respect to a centerline of the waveguide. After all, the two components in the directions of the rectangular waveguide branching units 35*c* and 35*d* toward which the electric wave V is separated made to branch are combined into a composite wave signal by the rectangular waveguide E-plane T-branching circuit 38 and the composite wave signal is efficiently outputted via the input/output terminal P6 without the reflection characteristics of the waveguide orthomode transducer being impaired.

Although the explanation of the principle of operation of the waveguide orthomode transducer is made as to the case where the input/output terminal P4 is used as an input terminal and the input/output terminals P5 and P6 are used as output terminals, the waveguide orthomode transducer of this embodiment operates on the same principle of operation even in a case where the input/output terminals P5 and P6 are used as input terminals and the input/output terminal P4 is used as an output terminal.

As can be seen from the above description, this embodiment 3 offers an advantage of being able to provide good reflection characteristics and isolation characteristics in a wide frequency band including a frequency range close to the cut-off frequency of the basic mode of the square main waveguide 32. Since the length of the square main waveguide 31 in the direction of its waveguide axis can be shortened in each of the waveguide orthomode transducers 1, 8, and 13, the physical size of the antenna apparatus can be reduced.

Embodiment 4

The antenna apparatus in accordance with above-mentioned embodiment 3 uses the waveguide orthomode transducers 1, 8, and 13 each having a structure shown in FIGS. 4 and 5, as previously explained. As an alternative, the antenna apparatus uses waveguide orthomode transducers 1, 8, and 13 each having a structure shown in FIGS. 6 and 7. The waveguide orthomode transducers 1, 8, and 13 can have the same structure. For the sake of simplicity, FIGS. 6 and 7 show the structure of the waveguide orthomode transducer 13.

Figure 6:
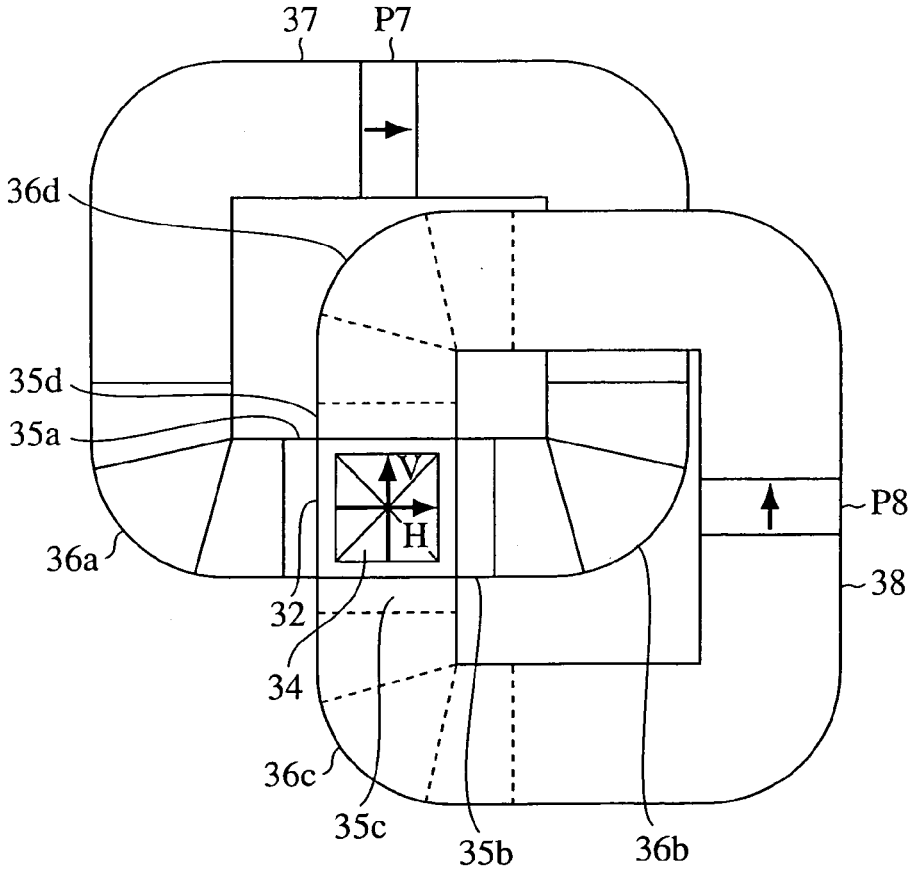
FIG. 6 is a top plan view showing a waveguide orthomode transducer of an antenna apparatus according to embodiment 4 of the present invention.
Figure 7:
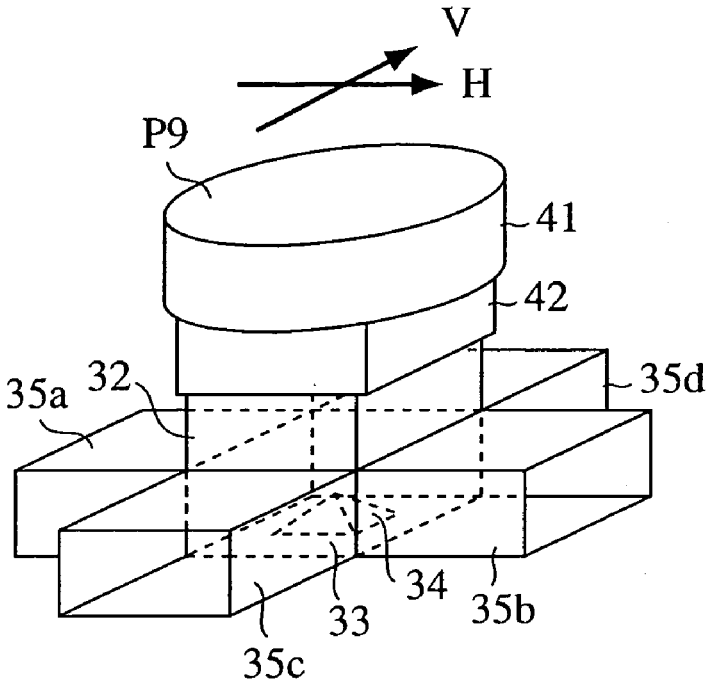
FIG. 7 is a perspective diagram showing the waveguide orthomode transducer of FIG. 6.

In FIGS. 6 and 7, the same reference numerals as shown in FIGS. 4 and 5 denote the same components or like components, and therefore the explanation of these components will be omitted hereafter.

When receiving a circularly polarized wave signal C2 outputted thereto from a primary radiator 14 via an input/output terminal P9, a circular main waveguide 41 transmits the circularly polarized wave signal (including a vertically polarized electric wave and a horizontally polarized electric wave) C2. Another square main waveguide 42 is connected to the circular main waveguide 41, and has an aperture diameter larger than that of a square main waveguide 32 and a level difference at a connecting portion where it is connected to the square main waveguide 32, the level difference being sufficiently smaller than the free space wavelength of an available frequency band. The square main waveguide 42 transmits the circularly polarized wave signal (including a vertically polarized electric wave and a horizontally polarized electric wave) C2 transmitted thereto by the square main waveguide 42.

When the antenna apparatus receives a horizontally polarized electric wave H of basic mode (i.e., TE01 mode) via the input/output terminal P9, the circular main waveguide 41 and the square main waveguides 42 and 32 transmit the horizontally polarized electric wave H to a quadrangular-pyramid-shaped metallic block.

When the horizontally polarized electric wave H then reaches the quadrangular-pyramid-shaped metallic block 34, the quadrangular-pyramid-shaped metallic block makes it branch toward both the direction of a rectangular waveguide branching unit 35*a* and the direction of a rectangular waveguide branching unit 35*b* (in the figures, in the directions of H).

In other words, since each of rectangular waveguide branching units 35*c* and 35*d* has upper and lower walls having a gap which is equal to or smaller than one half of the free space wavelength of the available frequency band, the horizontally polarized electric wave H is not made to branch toward the directions of the rectangular waveguide branching units 35*c* and 35*d* (in the figures, in the directions of V) due to the interception effect of the rectangular waveguide branching units 35*c* and 35*d*, but is made to branch toward the directions of the rectangular waveguide branching units 35*a* and 35*b* (in the figures, in the directions of H).

Since the orientation of the electric field is changed along the quadrangular-pyramid-shaped metallic block 34 and a short-circuit plate 33, the electric field has a distribution equivalent to an electric field distribution provided by two rectangular waveguide E-plane miter bends having excellent reflective characteristics which are placed so that they are symmetric to each other. Therefore, the horizontally polarized electric wave H is efficiently outputted in the directions of the rectangular waveguide branching units 35*a* and 35*b* while leakage of the horizontally polarized electric wave H in the directions of the rectangular waveguide branching units 35*c* and 35*d* is suppressed.

A connecting portion where the circular main waveguide 41 is connected to the square main waveguide 42, the square main waveguide 42, and a connecting portion where the square main waveguide 42 is connected to the square main waveguide 32 serve as a circular-to-rectangular waveguide multi-stage transformer. Therefore, when the diameter of the circular main waveguide 41, the diameter of the square main waveguide 42 and the length of the waveguide axis of the square main waveguide 42 are properly designed, the circular-to-rectangular waveguide multi-stage transformer has reflection characteristics in which there is a large reflection loss in a frequency band near the cut-off frequency of the basic mode of the horizontally polarized electric wave H and there is a very small reflection loss in a frequency band to some extent higher than the cut-off frequency. The reflection characteristics are similar to the reflection characteristics of the above-mentioned branching portion at which the horizontally polarized electric wave H is made to branch toward the directions of the rectangular waveguide branching units 35*a* and 35*b*, and the above-mentioned circular-to-rectangular waveguide multi-stage transformer is positioned so that a reflected wave from the branching portion and a reflected wave from the above-mentioned circular-to-rectangular waveguide multi-stage transformer cancel each other out in a band close to the cut-off frequency. Therefore, any degradation in the reflection characteristics in the frequency band near the cut-off frequency can be suppressed without impairing the good reflection characteristics in the frequency band to some extent higher than the cut-off frequency of the basic mode of the horizontally polarized electric wave H.

Each of the rectangular waveguide multi-stage transformers 36*a* and 36*b* has a waveguide axis which is curved, and has an upper wall in which two or more level differences are formed and the level differences are arranged at intervals of about one quarter of the wavelength of an electric wave propagating therethrough with respect to a centerline of the waveguide. After all, the two components in the directions of the rectangular waveguide branching units 35*a* and 35*b* toward which the electric wave H is made to branch toward are combined into a composite wave signal by a rectangular waveguide E-plane T-branching circuit 37 and the composite wave signal is efficiently outputted via an input/output terminal P7 without the reflection characteristics of the waveguide orthomode transducer being impaired.

On the other hand, when the waveguide orthomode transducer receives a vertically polarized electric wave V of basic mode (i.e., TE10 mode) via the input/output terminal P9, the circular main waveguide 41 and the square main waveguides 42 and 32 transmit the vertically polarized electric wave V to the quadrangular-pyramid-shaped metallic block.

When the vertically polarized electric wave V then reaches the quadrangular-pyramid-shaped metallic block 34, the quadrangular-pyramid-shaped metallic block makes it branch toward both a direction of the rectangular waveguide branching unit 35*c* and a direction of the rectangular waveguide branching unit 35*d* (in the figures, in the directions of V).

In other words, since each of the rectangular waveguide branching units 35*a* and 35*b* has upper and lower walls having a gap which is equal to or smaller than one half of the free space wavelength of the available frequency band, the vertically polarized electric wave V is not made to branch toward the directions of the rectangular waveguide branching units 35*a* and 35*b* (in the figures, in the directions of H) due to the interception effect of the rectangular waveguide branching units 35*a* and 35*b*, but is made to branch toward the directions of the rectangular waveguide branching units 35*c* and 35*d* (in the figures, in the directions of V).

Since the orientation of the electric field is changed along the quadrangular-pyramid-shaped metallic block 34 and the short-circuit plate 33, the electric field has a distribution equivalent to an electric field distribution provided by two rectangular waveguide E-plane miter bends having excellent reflection characteristics which are placed so that they are symmetric to each other. Therefore, the vertically polarized electric wave V is efficiently outputted in the directions of the rectangular waveguide branching units 35*c* and 35*d* while leakage of the vertically polarized electric wave V in the directions of the rectangular waveguide branching units 35*a* and 35*b* is suppressed.

The connecting portion where the circular main waveguide 41 is connected to the square main waveguide 42, the square main waveguide 42, and the connecting portion where the square main waveguide 42 is connected to the square main waveguide 32 serve as a circular-to-rectangular waveguide multi-stage transformer. Therefore, when the diameter of the circular main waveguide 41, the diameter of the square main waveguide 42 and the length of the waveguide axis of the square main waveguide 42 are properly designed, the circular-to-rectangular waveguide multi-stage transformer has reflection characteristics in which there is a large reflection loss in a frequency band near the cut-off frequency of the basic mode of the vertically polarized electric wave V and there is a very small reflection loss in a frequency band to some extent higher than the cut-off frequency. The reflection characteristics are similar to the reflection characteristics of the above-mentioned branching portion at which the vertically polarized electric wave V is made to branch toward the directions of the rectangular waveguide branching units 35*c* and 35*d*, and the above-mentioned circular-to-rectangular waveguide multi-stage transformer is positioned so that a reflected wave from the branching portion and a reflected wave from the above-mentioned circular-to-rectangular waveguide multi-stage transformer cancel each other out in a band close to the cut-off frequency. Therefore, any degradation in the reflection characteristics in the frequency band near the cut-off frequency can be suppressed without impairing the good reflection characteristics in the frequency band to some extent higher than the cut-off frequency of the basic mode of the vertically polarized electric wave V.

Each of the rectangular waveguide multi-stage transformers 36*c* and 36*d* has a waveguide axis which is curved, and has a lower wall in which two or more level differences are formed and the level differences are arranged at intervals of about one quarter of the wavelength of an electric wave propagating therethrough with respect to a centerline of the waveguide. After all, the two components in the directions of the rectangular waveguide branching units 35*c* and 35*d* toward which the electric wave V is made to branch are combined into a composite wave signal by a rectangular waveguide E-plane T-branching circuit 38 and the composite wave signal is efficiently outputted via an input/output terminal P6 without the reflection characteristics of the waveguide orthomode transducer being impaired.

Although the explanation of the principle of operation of the waveguide orthomode transducer is made as to the case where the input/output terminal P9 is used as an input terminal and the input/output terminals P7 and P8 are used as output terminals, the waveguide orthomode transducer of this embodiment operates on the same principle of operation even in a case where the input/output terminals P7 and P8 are used as input terminals and the input/output terminal P9 is used as an output terminal.

As can be seen from the above description, this embodiment 4 offers an advantage of being able to provide good reflection characteristics and isolation characteristics in a wide frequency band including a frequency range close to the cut-off frequency of the basic mode of the square main waveguide 32. Since the length of the square main waveguide 32 in the direction of its waveguide axis can be shortened in each of the waveguide orthomode transducers 1, 8, and 13, the physical size of the antenna apparatus can be reduced.

Embodiment 5

Figure 8:
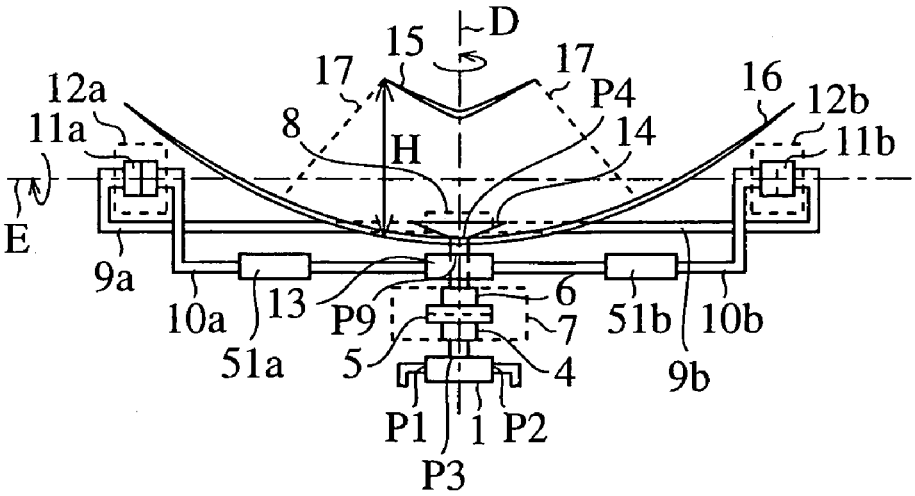
FIG. 8 is a side view showing an antenna apparatus according to embodiment 5 of the present invention.
Figure 9:
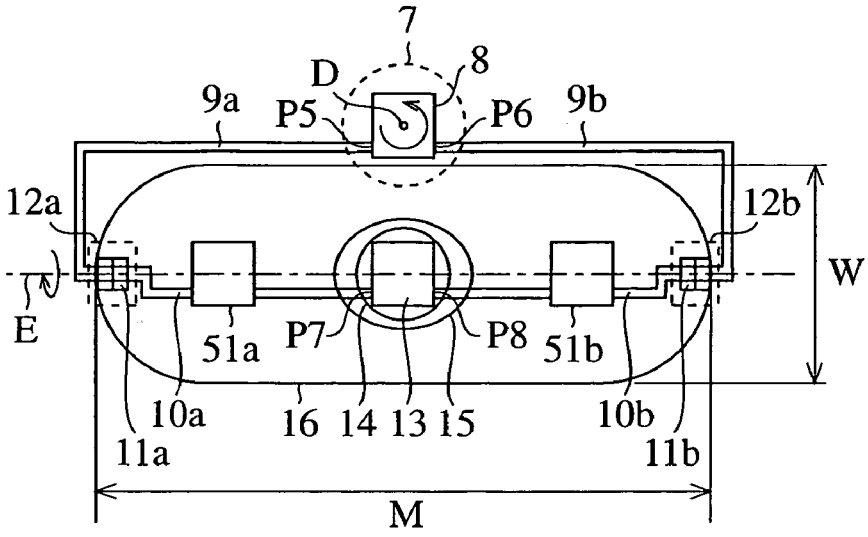
FIG. 9 is a top plan view showing the antenna apparatus of FIG. 8.

FIG. 8 is a side view showing an antenna apparatus according to embodiment 5 of the present invention, and FIG. 9 is a top plan view showing the antenna apparatus of FIG. 8.

In FIGS. 8 and 9, the same reference numerals as shown in FIGS. 1 and 2 denote the same components as shown in the figures or like components, the explanation of these components will be omitted hereafter.

RF modules 51*a* and 51*b* are inserted into rectangular waveguides 10*a* and 10*b*, and amplify linearly polarized wave signals L3 and L4, respectively.

Figure 10:
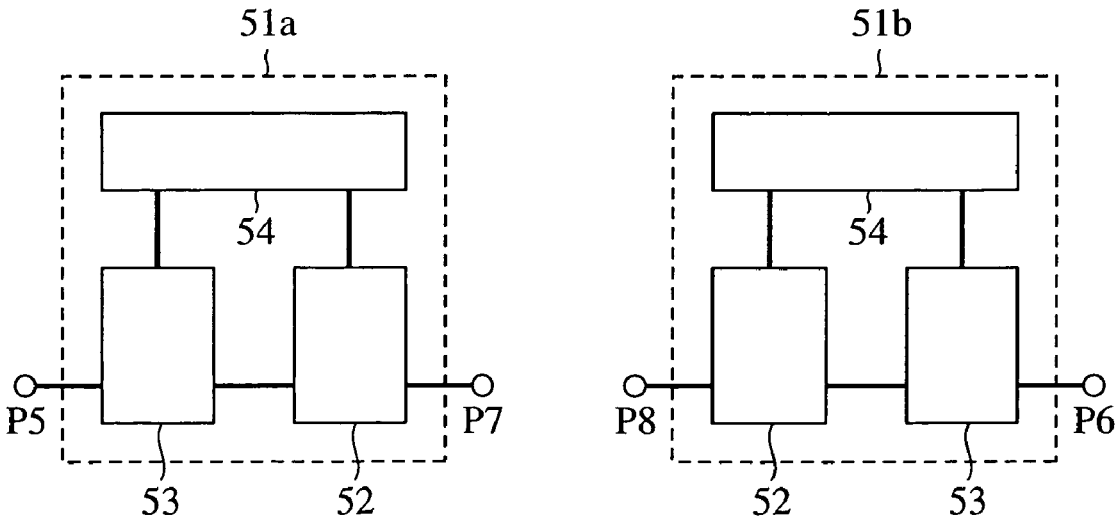
FIG. 10 is a block diagram showing an RF module.

FIG. 10 is a block diagram showing the RF modules 51*a* and 51*b*, and each of the RF modules 51*a* and 51*b* is provided with waveguide branching filters 52 and 53 and a low noise amplifier 54.

Since the antenna apparatus according to this embodiment has the same structure as that according to above-mentioned embodiment 1 with the exception that the RF modules 51*a* and 51*b* are inserted into the rectangular waveguides 10*a* and 10*b*, respectively, only the operation of each of the RF modules 51*a* and 51*b* will be explained hereafter.

In accordance with above-mentioned embodiment 1, the rectangular waveguides 9*a*, 10*a*, 9*b*, and 10*b* are routed so that the waveguide orthomode transducer 13 is disposed below the waveguide orthomode transducer 8, and therefore the linearly polarized wave signals L3 and L4 outputted from the waveguide orthomode transducer 13 decrease in magnitude with increase in the sizes of the rectangular waveguides 9*a*, 10*a*, 9*b*, and 10*b*.

In contrast, in accordance with this embodiment 5, the RF modules 51*a* and 51*b* amplify linearly polarized wave signals L3 and L4 outputted from the waveguide orthomode transducer 13, respectively, and also make linearly polarized wave signals L3 and L4 outputted from the waveguide orthomode transducer 8 pass therethrough, just as they are, respectively.

In other words, the waveguide branching filter 52 of the RF module 51*a* branches the linearly polarized wave signal L3 outputted from an input/output terminal P7 of the waveguide orthomode transducer 13 toward the low noise amplifier 54 without branching it toward the waveguide branching filter 53. As a result, the low noise amplifier 54 amplifies the linearly polarized wave signal L3, and the waveguide branching filter 53 then outputs the amplified linearly polarized wave signal L3 to an input/output terminal P5 of the waveguide orthomode transducer 8.

On the other hand, the waveguide branching filter 53 of the RF module 51*a* does not branch the linearly polarized wave signal L3 outputted from the input/output terminal P5 of the waveguide orthomode transducer 8 toward the low noise amplifier 54, but branches it toward the waveguide branching filter 52. The waveguide branching filter 52 then outputs the linearly polarized wave signal L3 to the input/output terminal P7 of the waveguide orthomode transducer 13.

Similarly, the waveguide branching filter 52 of the RF module 51*b* branches the linearly polarized wave signal L4 outputted from an input/output terminal P8 of the waveguide orthomode transducer 13 toward the low noise amplifier 54 without branching it toward the waveguide branching filter 53. As a result, the low noise amplifier 54 amplifies the linearly polarized wave signal L4, and the waveguide branching filter 53 then outputs the amplified linearly polarized wave signal L4 to an input/output terminal P6 of the waveguide orthomode transducer 8.

On the other hand, the waveguide branching filter 53 of the RF module 51*b* does not branch the linearly polarized wave signal L4 outputted from the input/output terminal P6 of the waveguide orthomode transducer 8 toward the low noise amplifier 54, but branches it toward the waveguide branching filter 52, and the waveguide branching filter 52 then outputs the linearly polarized wave signal L4 to the input/output terminal P8 of the waveguide orthomode transducer 13.

This embodiment 5 offers an advantage of being able to suppress degradation in quality due to a transmission loss of the linearly polarized wave signals L3 and L4 caused by the rectangular waveguides 9*a*, 10*a*, 9*b*, and 10*b*.

Embodiment 6

Figure 11:
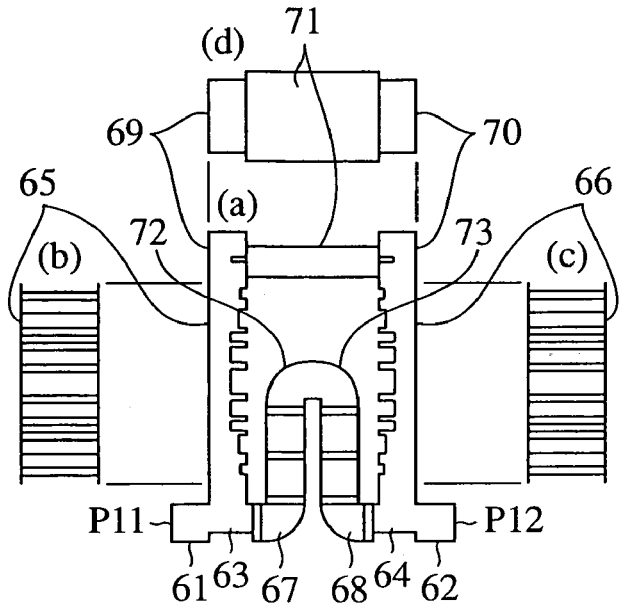
FIG. 11 is a block diagram showing an RF module.

In accordance with above-mentioned embodiment 5, each of the RF modules 51*a* and 51*b* is provided with the waveguide branching filters 52 and 53 and the low noise amplifier 54. In contrast, in accordance with this embodiment, the RF module 51*b* can have a structure as shown in FIG. 11. The RF module 51*a* can have the same structure as the RF module 51*b*, though the RF module 51*a* is not illustrated in the figure.

FIG. 11(*a*) is a cross-sectional view showing each of the RF modules 51*a* and 51*b*, FIG. 11(*b*) is a side view of a single-sided corrugated rectangular waveguide low pass filter 65 of FIG. 11(*a*) when viewed from the left side of the figure, FIG. 11(*c*) is a side view of a single-sided corrugated rectangular waveguide low pass filter 66 of FIG. 11(*a*) when viewed from the right side of the figure, FIG. 11(*d*) is a plan view of a low noise amplifier 71 and so on of FIG. 11(*a*) when viewed from the upper side of the figure.

When a linearly polarized wave signal L4 outputted from an input/output terminal P8 of a waveguide orthomode transducer 13, i.e., a basic mode (i.e., a rectangular waveguide TE01 mode) of an electric wave of a first frequency band is inputted to each RF module via an input/output terminal P11, this electric wave propagates through a rectangular main waveguide 61, a stepped rectangular waveguide E-plane T-branching circuit 63, and the single-sided corrugated rectangular waveguide low pass filter 65, and is then inputted into the low noise amplifier 71 constructed of an MIC via a rectangular-waveguide-to-MIC converter 69. This electric wave is then amplified by the low noise amplifier 71.

The amplified electric wave is then outputted from another rectangular-waveguide-to-MIC converter 70, propagates through the single-sided corrugated rectangular waveguide low pass filter 66, another stepped rectangular waveguide E-plane T-branching circuit 64, and a rectangular main waveguide 62, and is outputted, as the basic mode of the rectangular waveguide, to an input/output terminal P6 of a waveguide orthomode transducer 8 via an input/output terminal P12.

On the other hand, when a linearly polarized wave signal L4 outputted from the input/output terminal P6 of the waveguide orthomode transducer 8, i.e., a basic mode (i.e., a rectangular waveguide TE01 mode) of an electric wave of a second frequency band higher than the first frequency band is inputted to each RF module via the input/output terminal P12, this electric wave propagates through the rectangular main waveguide 62, the stepped rectangular waveguide E-plane T-branching circuit 64, inductive iris coupled rectangular waveguide band pass filters 68 and 67, the stepped rectangular waveguide E-plane T-branching circuit 63, and the rectangular main waveguide 61, and is outputted, as the basic mode of the rectangular waveguide, to the input/output terminal P8 of the waveguide orthomode transducer 13 via the input/output terminal P11.

Each of the single-sided corrugated rectangular waveguide low pass filters 65 and 66 is so designed as to allow any electric wave of the first frequency band to pass therethrough and to reflect any electric wave of the second frequency band. In contrast, each of the inductive iris coupled rectangular waveguide band pass filters 67 and 68 is so designed as to allow any electric wave of the second frequency band to pass therethrough and to reflect any electric wave of the first frequency band.

In addition, the stepped rectangular waveguide E-plane T-branching circuit 63 has a matching step that is disposed at a branching portion thereof and is designed so that both a reflected wave caused thereby when an electric wave of the first frequency band is incident thereupon from the rectangular main waveguide 61, and a reflected wave caused thereby when an electric wave of the second frequency band is incident thereupon from the inductive iris coupled rectangular waveguide band pass filter 67 are reduced as much as possible, respectively.

Similarly, the stepped rectangular waveguide E-plane T-branching circuit 64 has a matching step that is disposed at a branching portion thereof and is designed so that both a reflected wave caused thereby when an electric wave of the first frequency band is incident thereupon from the single-sided corrugated rectangular waveguide low pass filter 66, and a reflected wave caused thereby when an electric wave of the second frequency band is incident thereupon from the rectangular main waveguide 62 are reduced as much as possible, respectively.

As a result, the electric wave of the first frequency band inputted to each RF module via the input/output terminal P11 is efficiently inputted into the low noise amplifier 71 while both reflection of the electric wave to the input/output terminal P11, and direct leakage of the electric wave to the stepped rectangular waveguide E-plane T-branching circuit 64 are suppressed. Furthermore, the electric wave of the first frequency band amplified by the low noise amplifier 71 is efficiently outputted via the input/output terminal P12 without being sent back to the stepped rectangular waveguide E-plane T-branching circuit 63.

In addition, the electric wave of the second frequency band inputted to each RF module via the input/output terminal P11 is efficiently outputted via the input/output terminal P11 while both reflection of the electric wave to the input/output terminal P12 and leakage of the electric wave to the low noise amplifier 71 are suppressed.

According to this embodiment 6, at the same time that each RF module efficiently amplifies and makes an electric wave of the first frequency band inputted thereto via the input/output terminal P11 pass therethrough without making the electric wave oscillate, each RF module can make most of an electric wave of the second frequency band inputted thereto via the input/output terminal P12 pass therethrough with almost no loss of the electric wave. In addition, when the number of resonators included in each of the inductive iris coupled rectangular waveguide band pass filters 67 and 68 is properly reduced, the distance between the input/output terminal P11 to the input/output terminal P12 is shortened. In this case, the physical size and weight of each RF module can be reduced and the performance of each RF module can be enhanced.

Embodiment 7

Figure 12:
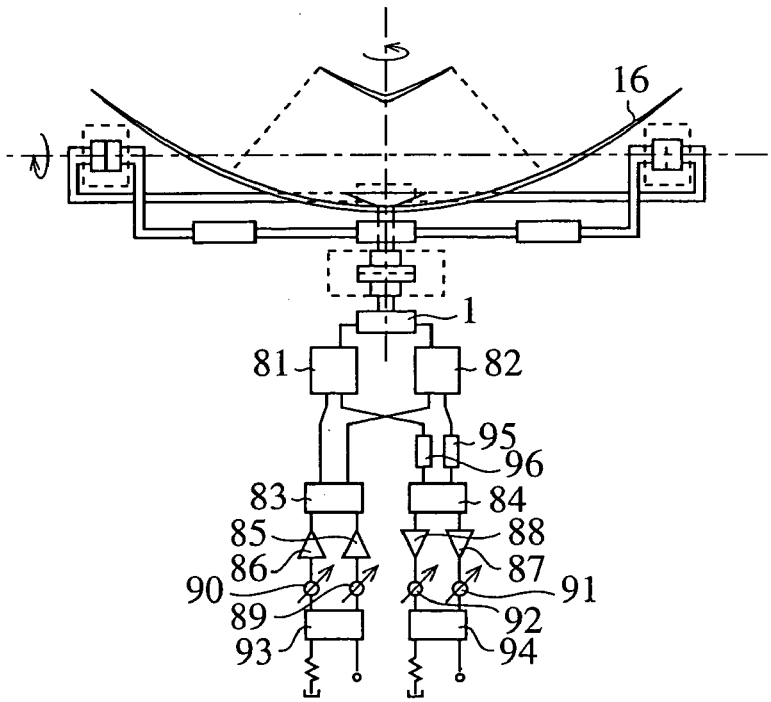
FIG. 12 is a side view showing an antenna apparatus according to embodiment 7 of the present invention.

In the antenna apparatus according to either of above-mentioned embodiments 1 to 6, a linearly polarized wave signal L1 is outputted or inputted via the input/output terminal P1 of the waveguide orthomode transducer 1, and a linearly polarized wave signal L2 is outputted and inputted via the input/output terminal P2, as previously mentioned. In contrast, an antenna apparatus according to this embodiment is provided with an input/output means for outputting or inputting a linearly polarized wave signal L1 via an input/output terminal P1 of a waveguide orthomode transducer 1, and for outputting or inputting a linearly polarized wave signal L2 via an input/output terminal P2 of the waveguide orthomode transducer 1, as shown in FIG. 12.

In this embodiment, the input/output means comprises waveguide branching filters 81 and 82, a waveguide 90-degree hybrid circuit 83, a coaxial-cable 90-degree hybrid circuit 84, high power amplifiers 85 and 86, low noise amplifiers 87 and 88, variable phase shifters 89 to 92, coaxial-cable 90-degree hybrid circuits 93 and 94, and coaxial-cable-to-waveguide converters 95 and 96.

Thus, by using the input/output means, the antenna apparatus can receive a right-hand circularly polarized wave signal and a left-hand circularly polarized wave signal, and can also transmit and receive a linearly polarized wave having an arbitrary angle.

INDUSTRIAL APPLICABILITY

As mentioned above, the antenna apparatus in accordance with the present invention can be used in a VHF band, a UHF band, a microwave band, a millimeter wave band, etc.

The invention claimed is:

1. An antenna apparatus comprising: a first orthomode transducer for combining first and second linearly polarized wave signals into a circularly polarized wave signal and for outputting the circularly polarized wave signal; a second orthomode transducer disposed above said first orthomode transducer, for separating the circularly polarized wave signal outputted thereto from said first orthomode transducer into third and fourth linearly polarized wave signals, and for outputting them; a first rectangular waveguide for propagating the third linearly polarized wave signal outputted thereto from said second orthomode transducer; a second rectangular waveguide disposed bilateral symmetrically to said first rectangular waveguide, for propagating the fourth linearly polarized wave signal outputted thereto from said second orthomode transducer; a third orthomode transducer disposed below said second orthomode transducer, for combining the third and fourth linearly polarized wave signals respectively propagated thereto by said first and the second rectangular waveguides into a circularly polarized wave signal, and for outputting the circularly polarized wave signal; and a radiator disposed above said third orthomode transducer, for emitting the circularly polarized wave signal outputted thereto from said third orthomode transducer to a reflector.

2. The antenna apparatus according to claim 1, characterized in that when said radiator receives a circularly polarized wave signal from said reflector, said third orthomode transducer separates the circularly polarized wave signal into third and fourth linearly polarized wave signals and outputs them, and, when receiving third and fourth linearly polarized wave signals from the first and the second rectangular waveguides, respectively, said second orthomode transducer combines said third and fourth linearly polarized wave signals into a circularly polarized wave signal, and outputs it, and said first orthomode transducer separates the circularly polarized wave signal into first and second linearly polarized wave signals and outputs them.

3. The antenna apparatus according to claim 2, characterized in that an elevation angle rotary member for supporting rotation of said radiator and said reflector in a direction of an elevation angle is inserted into each of said first and second rectangular waveguides.

4. The antenna apparatus according to claim 3, characterized in that an azimuth rotary member for supporting rotation of said radiator and said reflector in a direction of an azimuth angle is inserted between said first orthomode transducer and said second orthomode transducer.

5. The antenna apparatus according to claim 3, characterized in that said elevation angle rotary member is constructed using a coaxial-cable rotary joint.

6. The antenna apparatus according to claim 1, characterized in that each of said orthomode transducers comprises an electric wave branching means for, when receiving a circularly polarized wave signal, making a horizontally polarized electric wave included in the input circularly polarized wave signal branch toward first horizontal symmetrical directions, and making a vertically polarized electric wave included in the circularly polarized wave signal branch toward second horizontal symmetrical directions, a first electric wave propagating means for propagating a part of the horizontally polarized electric wave and a remaining part of the horizontally polarized electric wave branched by said electric wave branching means, for combining both the parts of the horizontally polarized electric wave into a linearly polarized wave signal, and for outputting it, and a second electric wave propagating means for propagating a part of the vertically polarized electric wave and a remaining part of the vertically polarized electric wave branched by said electric wave branching means, for combining both the parts of the vertically polarized electric wave into a linearly polarized wave signal, and for outputting it.

7. The antenna apparatus according to claim 2, characterized in that an RF module for amplifying a linearly polarized wave signal inputted thereto is inserted into each of said first and second rectangular waveguides.

8. The antenna apparatus according to claim 7, characterized in that said RF module comprises an amplification path for amplifying the linearly polarized wave signal outputted from said third orthomode transducer and for outputting the amplified, linearly polarized wave signal to said second orthomode transducer, and a passage path for outputting the linearly polarized wave signal outputted from said second orthomode transducer to said third orthomode transducer.

9. The antenna apparatus according to claim 2, characterized in that said apparatus is provided with an input/output means for inputting and outputting the first and second linearly polarized wave signals to and from the first orthomode transducer.

10. The antenna apparatus according to claim 3, characterized in that said reflector has a rectangular aperture having a larger size in a direction of an elevation angle axis than a size in a direction perpendicular to the elevation angle axis.

* * * * *